United States Patent [19]

Hu

[11] 3,954,516

[45] May 4, 1976

[54] METHOD FOR ENHANCING THE DRAWABILITY OF LOW MANGANESE STEEL STRIP

[75] Inventor: Hsun Hu, Franklin Township, Westmoreland County, Pa.

[73] Assignee: United States Steel Corporation, Pittsburgh, Pa.

[22] Filed: Sept. 30, 1974

[21] Appl. No.: 510,843

[52] U.S. Cl. ..... 148/12 C
[51] Int. Cl.[2] ..... C21D 9/48
[58] Field of Search ..... 148/12 C

[56] References Cited

UNITED STATES PATENTS

| | | | |
|---|---|---|---|
| 3,607,456 | 9/1971 | Forand, Jr. | 148/12 C |
| 3,663,310 | 5/1972 | Shiraiwa et al. | 148/12 C |
| 3,666,569 | 5/1972 | Hultgren | 148/12 C |
| 3,806,373 | 4/1974 | Shimizu et al. | 148/12 C |

*Primary Examiner*—W. Stallard
*Attorney, Agent, or Firm*—Arthur J. Greif

[57] ABSTRACT

The drawability of low carbon (0.015 to 0.06%), low Mn (<0.25%) steel strip, is improved by (i) employing cold reductions higher than is conventionally employed, i.e. > 80% and (ii) by annealing in the two-phase (ferrite and austenite) region. The effectiveness of such high temperature annealing and such high cold reductions is further enhanced as the phosphorus content increases.

7 Claims, 3 Drawing Figures

METHOD FOR ENHANCING THE DRAWABILITY OF LOW MANGANESE STEEL STRIP

This invention is directed to a method for the economical production of steel strip products with high deep drawability, as evidenced by $\bar{r}$ value, and is more particularly related to certain procedures for the cold reduction and annealing of low Mn steels.

It is generally recognized that the performance of a steel strip during forming operations, known as deep drawing, is closely associated with the ratio, $\bar{r}$, of true width strain to true thickness strain when the steel is strained in tension in the length direction. Therefore, the suitability of a steel for deep drawing may be assessed by measuring $r$ in the laboratory and the greater difficulty of full scale drawing trials can often be averted. It is normal to measure $r$ in the plane of the sheet in three directions, parallel to the rolling direction ($r_0$), diagonal to the rolling direction ($r_{45}$), and perpendicular to the rolling direction ($r_{90}$). From these three components, two summary characteristics are usually derived:

$$\bar{r} = (r_0 + 2r_{45} + r_{90})/4 \quad (1)$$

$$\Delta r = (r_0 - 2r_{45} + r_{90})/2 \quad (2)$$

High values of $\bar{r}$ are associated with a high capability to undergo deep drawing without fracture; and values of $\Delta r$ near zero are associated with a low tendency toward a detrimental directional nonuniformity in deep drawn items known as earing.

Isotropic steels have been produced with $\bar{r}$ and $\Delta r$ values near 1.0 and 0.0, respectively. Such steels have limited deep drawability but excellent resistance to earing. Cold-rolled rimmed sheet steels generally exhibit $\bar{r}$ and $\Delta r$ of the order of 1.2 and +0.4, respectively. Such steels can be subjected to mild deep drawing operations, but develop detrimental earing. Drawing-quality special-killed (DQSK) steels are often characterized by $\bar{r}$ and $\Delta r$ values near 1.5 and +0.5, respectively. Although these steels can withstand severe draws, they too tend to suffer from earing; and they are more costly to produce than rimmed steels. Recently sheet steels containing stabilizing elements such as columbium or titanium to combine with interstitial elements (eg. C and N) have appeared. These steels have $\bar{r}$ values of 2.0 or more and thus can withstand very severe deep drawing. Earing tendency may be small in some instances, as indicated by $\Delta r$ values near −0.1, or high in other instances, as indicated by $\Delta r$ values near +0.5. However, because of their columbium or titanium contents, these steels are very costly to produce. A significantly more economical method for achieving improved drawability, without the need for expensive stabilizing elements is shown in U.S. Pat. No. 3,709,744. However, the achievement of high drawability, as taught therein, is limited by two significant factors: (a) the Mn content must be kept below about 0.15% and (b) the oxygen content must be kept below about 150 ppm. The necessity for Mn to be below about 0.15% requires in turn that the S content be very low, otherwise the sheet will be susceptible to edge cracking. Similarly, the need for deoxidation adds to the cost of production.

It is therefore a principal object of this invention to provide methods for enhancing the drawability of "non-stabilized", low-Mn steels.

It is another object of this invention to provide a method for achieving $\bar{r}$ values equal or superior to that of DQSK steels without the necessity for deoxidation.

It is a further object of this invention to provide a method for increasing the above noted limits of Mn and nevertheless achieves $\bar{r}$ values equal or superior to that of DQSK steels.

It is yet another object of this invention to provide a method for further enhancing the $\bar{r}$ values of steels of the type shown in U.S. Pat. 3,709,744.

These and other objects and advantages of the instant invention will become more apparent from the following description when taken in conjunction with the appended claims and the drawings, in which:

Figure 1:
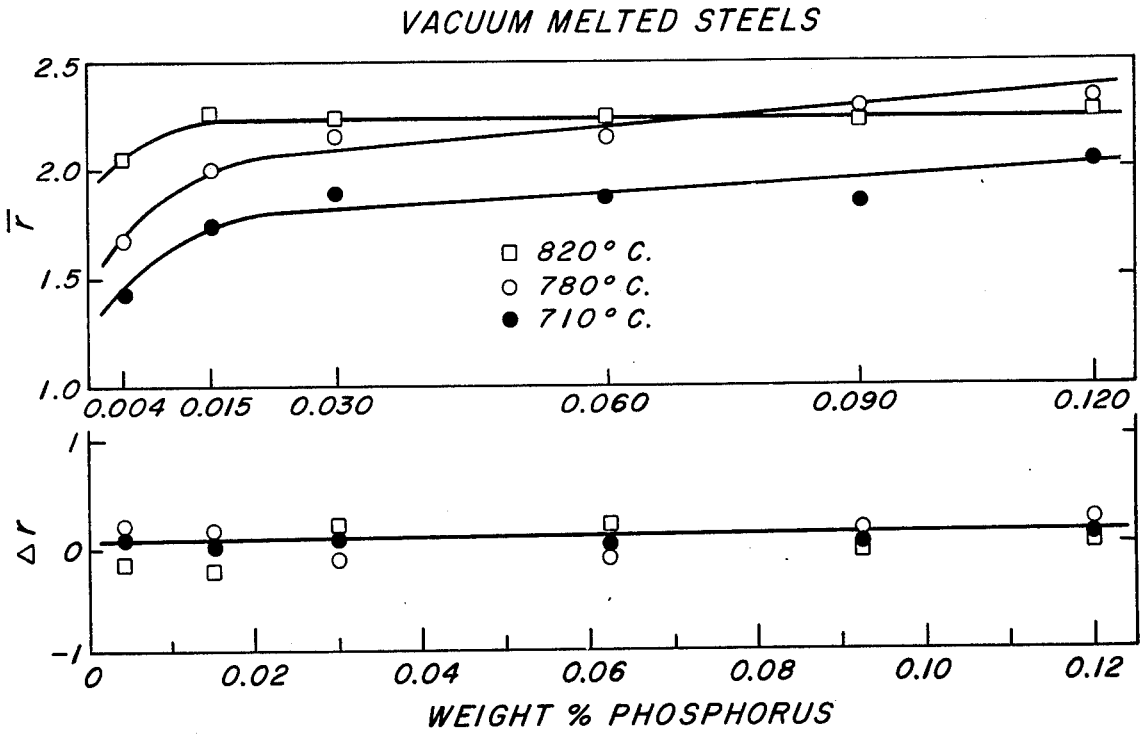
FIG. 1 is a graph showing the effect of both annealing temperature and phosphorus content on anisotropy parameters of vacuum melted low-Mn steels.

In the conventional production of deep drawing, steel strip (the term "strip" as used herein includes sheet, as well) the hot rolled band is coiled and cooled to about room temperature, cold reduced to a reduction in thickness in excess of about 60% and then annealed in the single phase alpha region, (i.e. within a temperature range of from about 1200° F to the alpha-gamma transformation temperature). Such annealing is conducted for a time sufficient to impart the desired crystallographic texture, as evidenced by $\bar{r}$, cup depth, etc. It is already known, when such annealing is conducted within the bounds of the single phase region, that the maximum $\bar{r}$ attainable will increase as annealing temperature is increased. Thus, U.S. Pat. No. 3,607,456 shows that when C is stabilized with Ti, that by employing annealing temperatures in excess of about 1500° F, $\bar{r}$ will increase with temperature up to the bounds of the two-phase region. Ostensibly, the same would be true for a Cb stabilized steel. In a similar manner, Teshima et al (*Mechanical Working of Steel*, TMS-AIME Confer., Vol. 26, 1964, pp. 279–320, at 306) show that in decarburized steels, i.e. wherein C is totally soluble in alpha iron, $\bar{r}$ value will also increase with temperature. By contrast, however, it is generally expected that annealing in the two-phase alpha + gamma region would either be adverse to or, at best, have no effect on drawability.

It has now been found that low Mn steels behave in a quite different manner. That is, the $\bar{r}$ values of such low Mn steels can be increased by annealing within the two-phase region. More specifically, the $\bar{r}$ values of low Mn steel strip annealed within the two-phase region (i.e. at temperatures from the $Ac_1$, to the $Ac_3$) will increase with: (1) the annealing temperature, with temperatures of from 760° to 850° C being preferred; (2) the degree of prior cold reduction, with reductions of 80 to 90% being preferred; and (3) phosphorus contents up to about 0.12%, with 0.04 to 0.08% P being preferred, especially in steels with oxygen contents in excess of about 300 ppm.

Preliminary studies using dynamic modulus measurements indicated the beneficial effect on $\bar{r}$ values, as noted above, of annealing temperature, cold reduction and P additions. In view thereof, further studies using mechanical measurements were conducted to verify those initial findings: six 50-pound ingots of low-Mn steel, with varying P contents, were cast from a 300-pound vacuum melted heat. Three 100-pound ingots, with different P contents, were also cast from a 300-pound air melted heat. In the latter air melted ingots, small amounts of Al were used to control the rimming action during solidification. The resulting ingots of both the vacuum and air melted heats were first rolled to plates less than one-inch thick. The chemical compositions of the resulting plates are shown in Tables I and II.

TABLE I

Chemical Compositions of the Vacuum-Melted Steels, wt %

| No. | C | Mn | P | S | Si | Cu | Ni | Cr | N | Al Sol | Al Insol | Al Total | Oxygen ppm |
|---|---|---|---|---|---|---|---|---|---|---|---|---|---|
| C-1 | 0.016 | 0.11 | 0.12 | 0.010 | 0.034 | 0.007 | 0.022 | 0.018 | 0.004 | <0.001 | 0.001 | <0.002 | 34 |
| C-2 | 0.018 | 0.11 | 0.091 | 0.016 | 0.034 | 0.007 | 0.022 | 0.016 | 0.004 | 0.001 | 0.004 | 0.005 | 37 |
| C-3 | 0.018 | 0.11 | 0.062 | 0.016 | 0.034 | 0.007 | 0.022 | 0.016 | 0.004 | 0.001 | <0.001 | <0.002 | 45 |
| C-4 | 0.019 | 0.11 | 0.030 | 0.016 | 0.030 | 0.007 | 0.020 | 0.014 | 0.003 | 0.001 | <0.001 | <0.002 | 46 |
| C-5 | 0.019 | 0.10 | 0.015 | 0.016 | 0.032 | 0.007 | 0.020 | 0.016 | 0.004 | 0.001 | <0.001 | <0.002 | 47 |
| C-6 | 0.020 | 0.10 | 0.004 | 0.016 | 0.024 | 0.007 | 0.020 | 0.014 | 0.003 | 0.001 | <0.001 | <0.002 | 59 |

TABLE II

Chemical Compositions of the Air-Melted Steels, wt %

| No. | C | Mn | P | S | Si | Cu | Ni | Cr | N | Al Sol | Al Insol | Al Total | Oxygen ppm |
|---|---|---|---|---|---|---|---|---|---|---|---|---|---|
| D-1 | 0.020 | 0.10 | 0.041 | 0.018 | 0.016 | 0.014 | 0.015 | 0.025 | 0.006 | 0.007 | 0.054 | 0.061 | 658 |
| D-2 | 0.018 | 0.11 | 0.072 | 0.016 | 0.008 | 0.012 | 0.015 | 0.026 | 0.005 | 0.003 | 0.019 | 0.022 | 625 |
| D-3 | 0.016 | 0.14 | 0.09 | 0.016 | 0.011 | 0.012 | 0.015 | 0.024 | 0.006 | 0.001 | 0.017 | 0.018 | 780 |

Figure 2:
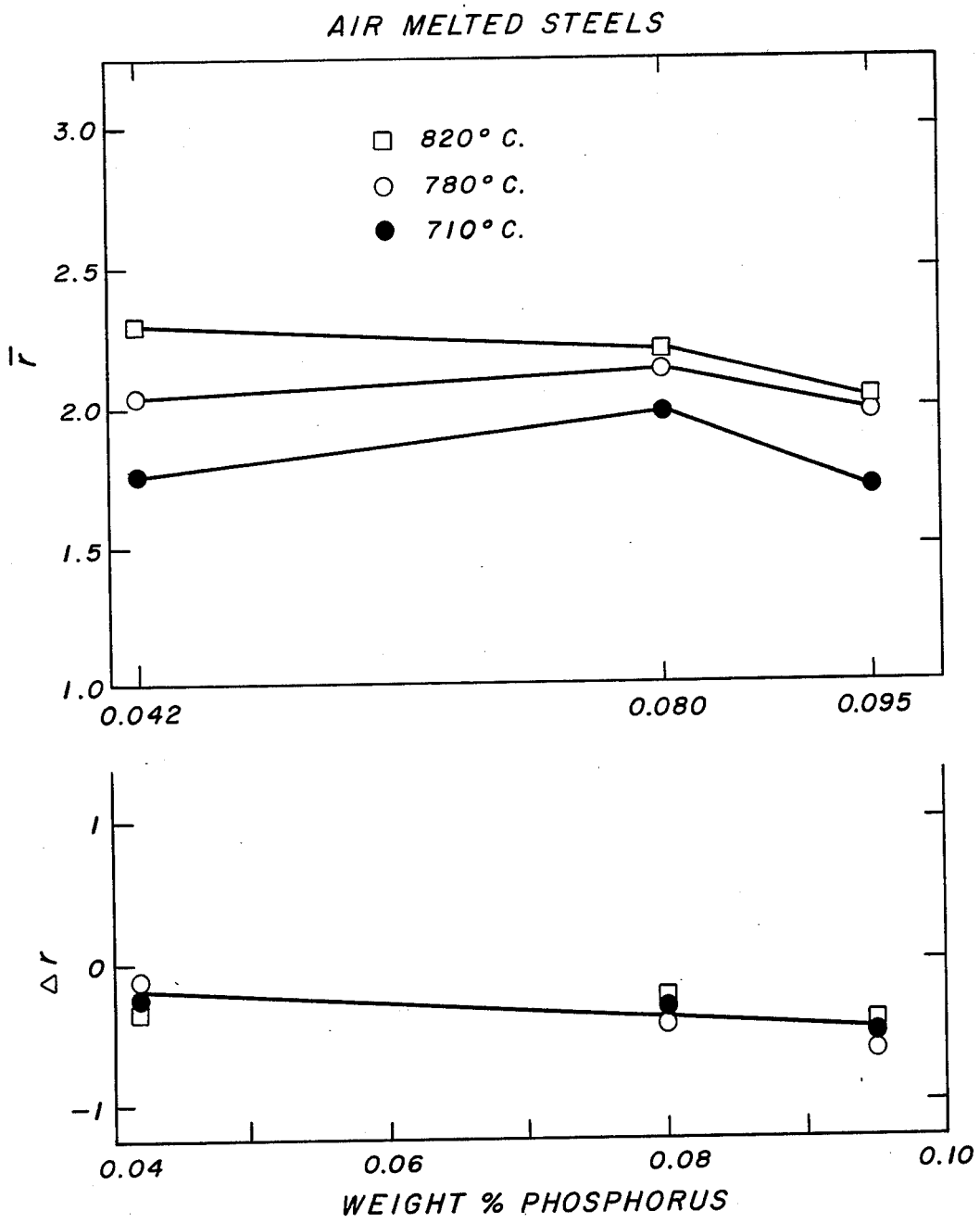
FIG. 2 is a graph showing the effect of both annealing temperature and phosphorus content on anisotropy parameters of air melted low-Mn steels.

Final hot processing then consisted of reheating the plates to 1230° C and hot rolling to a thickness of 0.15 inches, with a finishing temperature of about 950° C. The hot-rolled bands were immediately dipped into ice water for about 2 seconds to simulate water-spray cooling and then cooled from 620° C to room temperature at a rate of about 40° C/hour to simulate the cooling of coiled strip in commercial operations. The cooled bands were sandblasted, pickled and then cold rolled 80 percent to 0.030 inch-strip. Tension specimens were machined from blanks cut from the cold-rolled strips at 0, 45 and 90° to the rolling direction. These specimens were then annealed in 15 percent $H_2 + N_2$, at a heating rate of about 25° C/hour, to temperatures of 710° C, 780° C or 820° C, held at temperature for 20 hours and then furnace-cooled (simulated box anneal). The results are reported graphically in FIGS. 1 and 2. For both types of steels, the beneficial effect of annealing within the two-phase region (i.e. at 780° and 820° C) is clearly evident. For the air-melted steels, the beneficial effect of phosphorus appears to decline somewhat at phosphorus concentrations in excess of 0.08%. However, even at higher concentrations (i.e. up to 0.12% P) the $\bar{r}$ values obtained are still decidedly superior to similar air-melted low-Mn steels (see, for example, U.S. Pat. 3,709,744) containing little or no phosphorus (i.e. < 0.01%P). Thus, by employing phosphorus in excess of about 0.015%, preferably 0.04 to 0.08%, excellent deep drawability may be achieved in low-Mn steels without the need for deoxidation.

Since increased amounts of Mn and Si would be expected to have a detrimental effect on drawability, further investigations were conducted to investigate the limits of these two elements. The steels in these latter investigations were hot-rolled, cold-rolled and annealed in accord with the procedures outlined above, with the exception that only two annealing temperatures were employed, i.e. (i) 710° C — subcritical annealing and (ii) 780° C — intercritical annealing. The chemical compositions, $\bar{r}$ and $\Delta r$ values for these steels is reported below in Table III — (vacuum-melted) and Table IV — (air-melted), respectively.

TABLE III

Vacuum-Melted Steels

| No. | C | Mn | P | S | Si | Cu | Ni | Cr |
|---|---|---|---|---|---|---|---|---|
| E-1 | 0.020 | 0.201 | 0.043 | 0.021 | 0.021 | 0.005 | 0.020 | 0.020 |
| E-2 | 0.014 | 0.201 | 0.043 | 0.019 | 0.183 | 0.005 | 0.022 | 0.020 |
| E-3 | 0.020 | 0.205 | 0.044 | 0.020 | 0.365 | 0.007 | 0.022 | 0.020 |
| E-4 | 0.018 | 0.203 | 0.044 | 0.202 | 0.700 | 0.007 | 0.020 | 0.020 |

| No. | Al Sol | Al Total | N | Oxygen ppm | Subcritical Anneal-710°C $\bar{r}$ | Subcritical Anneal-710°C $\Delta r$ | Intercritical Anneal-780°C $\bar{r}$ | Intercritical Anneal-780°C $\Delta r$ |
|---|---|---|---|---|---|---|---|---|
| E-1 | <0.001 | <0.002 | 0.004 | 93 | 1.99 | −0.49 | 2.15 | −0.52 |
| E-2 | <0.001 | 0.002 | 0.006 | 52 | 2.23 | −0.24 | 2.52 | −0.29 |
| E-3 | <0.001 | 0.002 | 0.004 | 42 | 2.03 | 0.01 | 2.51 | 0.11 |
| E-4 | <0.001 | <0.002 | 0.003 | 52 | 2.01 | 0.10 | 2.27 | 0.26 |

TABLE IV

Air Melted Steels

| No. | C | Mn | P | S | Si | Cu | Ni | Cr |
|---|---|---|---|---|---|---|---|---|
| F-1 | 0.017 | 0.170 | 0.067 | 0.024 | 0.032 | 0.019 | 0.012 | 0.020 |
| F-2 | 0.014 | 0.176 | 0.066 | 0.023 | 0.168 | 0.019 | 0.012 | 0.020 |
| F-3 | 0.016 | 0.171 | 0.066 | 0.023 | 0.305 | 0.019 | 0.012 | 0.020 |
| F-4 | 0.016 | 0.186 | 0.066 | 0.022 | 0.780 | 0.021 | 0.010 | 0.020 |

TABLE III-continued

| No. | C | Mn | P | S | Si | Cu | Ni | Cr |
|---|---|---|---|---|---|---|---|---|
| | | | Vacuum-Melted Steels | | | | | |

| No. | Al Sol | Al Total | N | Oxygen ppm | Subcritical Anneal-710°C $\bar{r}$ | Subcritical Anneal-710°C $\Delta r$ | Intercritical Anneal-780°C $\bar{r}$ | Intercritical Anneal-780°C $\Delta r$ |
|---|---|---|---|---|---|---|---|---|
| F-1 | 0.007 | 0.009 | 0.005 | 387 | 2.09 | 0.10 | 2.35 | 0.25 |
| F-2 | <0.001 | 0.002 | 0.006 | 350 | 2.17 | 0.07 | 2.27 | 0.15 |
| F-3 | <0.001 | 0.002 | 0.005 | 285 | 2.11 | 0.15 | 2.34 | 0.22 |
| F-4 | <0.001 | 0.005 | 0.006 | 323 | 1.95 | 0.26 | 2.07 | 0.35 |

The results clearly show that excellent $\bar{r}$ and $\Delta r$ values are obtainable at all levels of Si and Mn which were employed above. From the results above and other work, it is therefore seen up to about 1.0% Si and up to about 0.25% Mn may be employed without any serious diminuition in $\bar{r}$ values. Additionally, with respect to the air-melted steels, it is seen that by employing greater than 0.015% P (in this case ~0.067%) relatively high $\bar{r}$ values may be obtained in steels with oxygen contents well in excess of 300 ppm. Finally, as expected, both sets of steels show that intercritical annealing (780° C) produced significantly higher $\bar{r}$ values than subcritical annealing (710° C).

Figure 3:
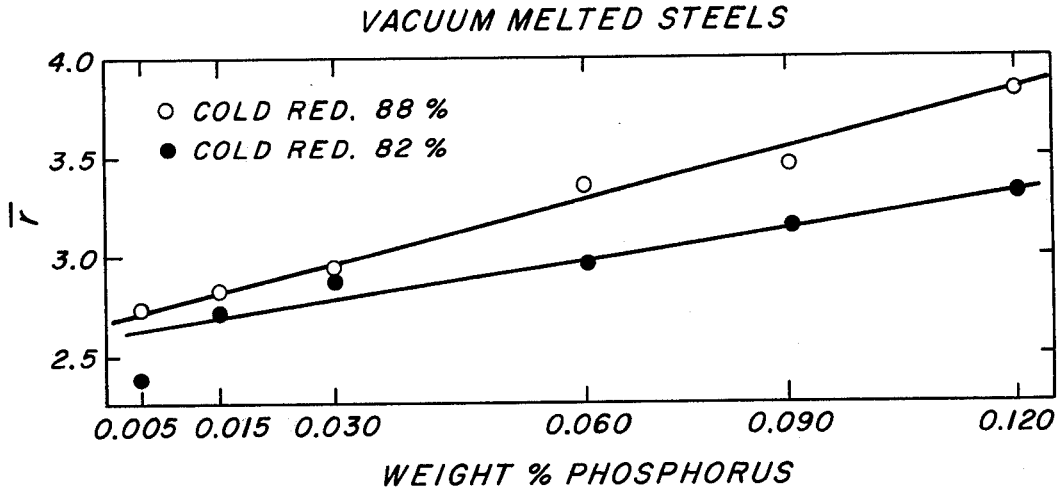
FIG. 3 is a graph showing the effect of both increased amounts of cold-reduction and phosphorus on $\bar{r}$ values of vacuum melted low-Mn steels.

FIG. 3 is a graphical representation of certain of the preliminary results obtained, as noted above, using dynamic modulus measurements. These preliminary tests were made on very thin strip, partially as a consequence of the relatively heavy cold reductions employed for the hot-rolled band. Although it will be difficult, in commercial practice, to obtain $\bar{r}$ values of the magnitude shown in this figure, the trend exhibited thereby is clearly evident. Thus, the beneficial effect of increased amounts of cold reduction is readily discernible. It may also be seen that the effectiveness of such higher than normal cold reductions is further enhanced, as the phosphorus content increases. Here again, it is seen that low-Mn steels appear to behave in a manner different from that of conventional deep-drawing steels, wherein cold reductions in excess of 80% are known to have an adverse effect on $\bar{r}$ value, (see, for example, U.S. Pat. 3,761,324).

The instant invention may therefore be conducted in the following manner. A steel melt is adjusted to contain from 0.015 to 0.06% C and from 0.01 to 0.25% Mn. For maximum drawability, it is desirable to employ less than 0.20% Mn and only as much as may be necessary, consistent with the S content of the melt, to ensure against hot shortness (edge-cracking). A Mn to S ratio of at least about 7:1 is generally desirable. P up to 0.12% may be added for its known effects, such as increasing strength, or to further enhance drawability in accord with the teachings herein. If maximum ductility and drawability are required, then (a) C will be near the low end of the range and preferably will be less than 0.04%, and (b) Si will not be intentionally added. However, if it is desired to maximize strength and nevertheless achieve $\bar{r}$ values equal or superior to that of DQSK steels, then Si of up to about 1.0%, preferably not greater than 0.7%, may be tolerated without any serious detriment to $\bar{r}$ value. Depending on the desired end use of the strip product and the economics involved, the heat may be deoxidized by any of the well known methods, for example: (i) killing with Al only, or by a combination of deoxidizing elements such as Al and Si; (ii) "rim-stabilizing", i.e. permitting the steel to rim for a period of time only sufficient to achieve a rimmed surface and then immediately killing the core with Al, or (iii) vacuum degassing. However, in contrast with the teachings of U.S. Pat. 3,709,744 deoxidation is no longer essential for the achievement of high $\bar{r}$ values.

The steel melt, with a composition within the limits prescribed above is then cast, such as by ingot casting or continuous casting procedures. The resultant ingots or slabs are then hot rolled to the desired band thickness, with a finishing temperature generally above 850° C and preferably above 900° C. The hot-rolled band is then preferably rapidly cooled, eg. by spray quenching, to coiling temperature and coiled. The coiled material is then surface cleaned in well known manner (pickling, etc.) and cold reduced to achieve a reduction in thickness of at least 60%. However, as shown herein, reductions in thickness of at least 80% are preferred to achieve maximum $\bar{r}$ value, especially in steels containing greater than 0.015% P. The resultant strip is then slowly heated, in a protective atmosphere, to final annealing temperature. The heat-up rate should be sufficiently slow to prevent undesirable nucleation and its attendant deleterious effect on $\bar{r}$ value. In general, the heat-up rate should be slower than 100° C/hr. and more preferably, slower than 50° C/hr. In accord with the teachings of this invention, the final anneal is conducted at a temperature within the two phase region, i.e. above the $Ac_1$, but below the $Ac_3$. The actual temperature employed will depend, to a great extent, on the desirability of maximizing $\bar{r}$; with temperatures of 760° to 850° C being preferred. However, in steels containing in excess of 0.04% C, the final temperature desirably will be below 800° C, since for such higher carbon steels there is a tendency for $\bar{r}$ to decrease at temperatures in excess thereof. In contrast thereto, when the carbon content is within the range of 0.015 to 0.03%, then higher temperatures, i.e. 800°–850° C are preferable for the achievement of maximum drawability.

I claim:

1. In the production of deep drawing steel strip, wherein hot rolled steel band, consisting essentially of, in weight percent,

| | |
|---|---|
| C | 0.015 to 0.06 |
| Mn | 0.01 to 0.25 |
| [P | 0.12 max.] |
| Si | 1.0 max. |

balance Fe and incidental steelmaking component elements, wherein at least 0.015% C is present in uncombined form, is cold rolled to effect a reduction in thickness of from 60 to 90 percent, and the resultant cold-reduced strip is thereafter slowly heated to an annealing temperature of at least about 650° C and held at said annealing temperature for a time sufficient to achieve a desired crystallographic texture, as evidenced by the $\bar{r}$ value of the resultant strip product, the improvement in which said band contains P in an amount of from 0.015 to 0.12% and said annealing temperature is above the $Ac_1$ temperature, but below the $Ac_3$ temperature for such steel.

2. The method of claim 1, where said annealing temperature is about 760° to 850° C.

3. The method of claim 2, where said band is cold reduced to achieve a reduction in thickness of at least 80 percent.

4. The method of claim 3, wherein the P content is at least 0.04%.

5. The method of claim 4, wherein the C, Mn and Si contents of the band are:

| | |
|---|---|
| C | 0.02 to 0.04% |
| Mn | 0.05 to 0.20% |
| Si | 0.7 max. |

6. The method of claim 5 wherein the oxygen content of the band is less than about 150 ppm.

7. The method of claim 5, wherein the oxygen content is greater than about 300 ppm and the P content is below about 0.08 percent.

* * * * *

UNITED STATES PATENT OFFICE

CERTIFICATE OF CORRECTION

Patent No. 3,954,516 Dated May 4, 1976

Inventor(s) Hsun Hu

It is certified that error appears in the above-identified patent and that said Letters Patent are hereby corrected as shown below:

Column 6, line 60, delete P 0.12.

Signed and Sealed this

Thirty-first Day of August 1976

[SEAL]

*Attest:*

RUTH C. MASON
*Attesting Officer*

C. MARSHALL DANN
*Commissioner of Patents and Trademarks*